US005103873A

United States Patent [19]

Bassi

[11] Patent Number: 5,103,873

[45] Date of Patent: Apr. 14, 1992

[54] MECHANISM FOR CONTROLLING GRIFFE FRAME MOVEMENT

[75] Inventor: Dario Bassi, Chaponnay, France

[73] Assignee: Establissements Staubli-Verdol S.A.R.L., Chassieu, France

[21] Appl. No.: 654,545

[22] Filed: Feb. 13, 1991

[30] Foreign Application Priority Data

Feb. 22, 1990 [FR] France ..... 90 02466

[51] Int. Cl.[5] ..... D03C 3/08; D03C 3/36

[52] U.S. Cl. ..... 139/59; 139/65

[58] Field of Search ..... 139/59, 65, 66; 74/25, 74/54

[56] References Cited

U.S. PATENT DOCUMENTS

| | | | |
|---|---|---|---|
| 3,096,792 | 7/1963 | Strach | 139/59 X |
| 3,480,044 | 11/1969 | Servillat | 139/59 |
| 4,022,251 | 5/1977 | Bucher | 139/59 |
| 4,936,352 | 6/1990 | Keim | 139/59 X |

*Primary Examiner*—Andrew M. Falik
*Attorney, Agent, or Firm*—Dowell & Dowell

[57] ABSTRACT

A mechanism for controlling the movement of the griffe frames of shed-forming device in a weaving loom which includes a pair of levers which are pivotally mounted to the loom frame work and to one of the griffe frames in such a manner as to define a shiftable quadrilateral linkage which when reciprocated causes the griffe frame to move obliquely from a lower to a higher position to allow passage of the picks of the loom.

2 Claims, 1 Drawing Sheet

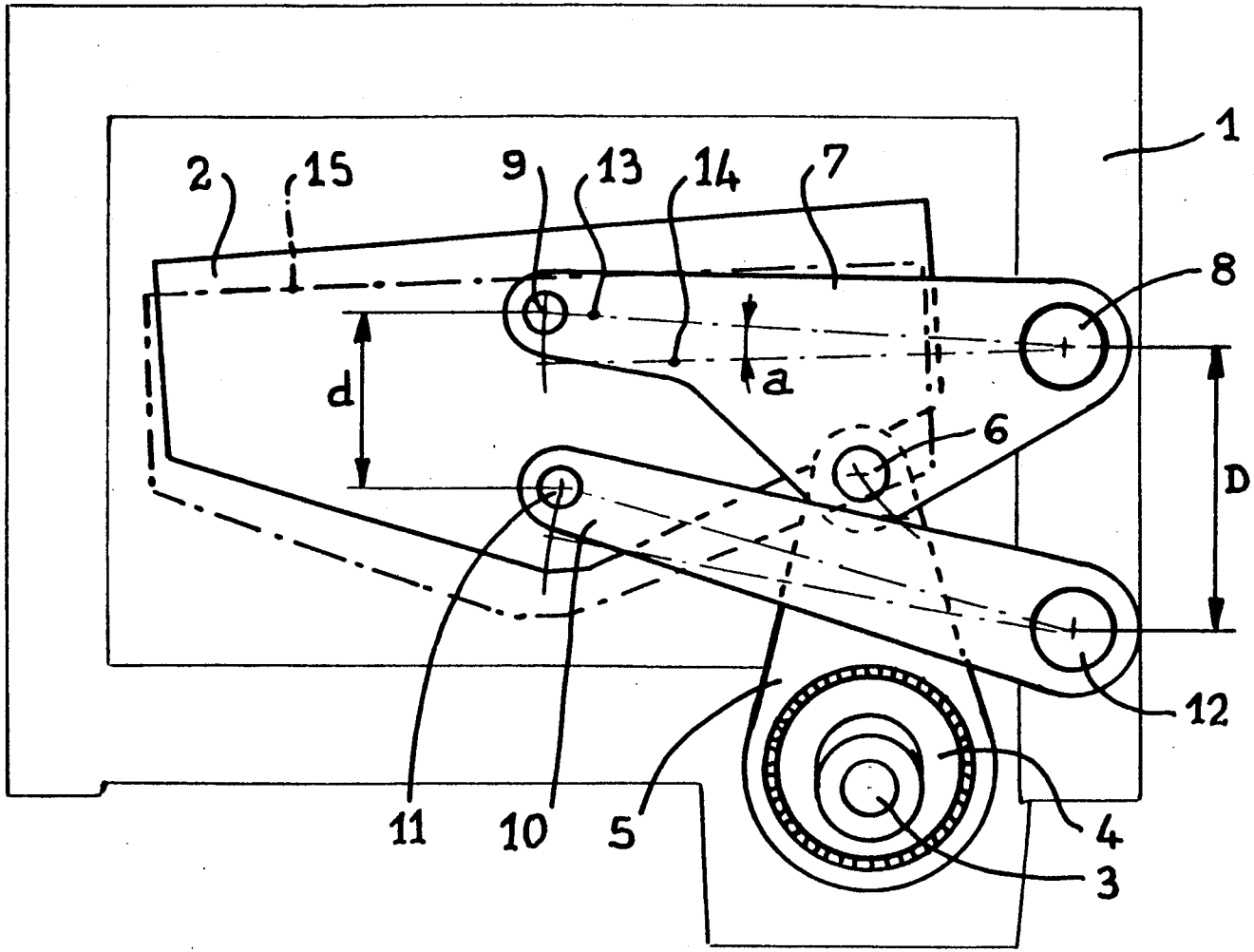
1
8
D
12
4
3
6
7
d
14
13
9
5
10
11
d
15
2

MECHANISM FOR CONTROLLING GRIFFE FRAME MOVEMENT

BACKGROUND OF THE INVENTION

1. Field of the Invention

The present invention relates to a mechanism for controlling the movement of the griffe frames of a shed-forming device.

2. History of the Related Art

In the shed-forming devices of a weaving loom, it is known to dispose hooks which are raised and lowered by two frames, carrying knives for actuating the hooks, which are called griffe frames.

The improvements forming the subject matter of the present invention are more particularly, although non-exclusively, applicable to a mechanism for forming the shed in a narrow fabric loom. Such a shed-forming device must have dimensions in length which are as small as possible so as to reduce the general dimensions and the masses in movement.

SUMMARY OF THE INVENTION

The control mechanism according to the invention comprises, on each side of its framework, on the one had a first lever articulated on the framework by one of its ends and on one of the griffe frames by its opposite end, while the lever is associated with a control employing reciprocating movement, and, on the other hand, a second lever of which the ends are articulated respectively on the griffe frame and the framework, so that the latter, the two levers and the griffe frame constitute a deformable quadrilateral. The distance separating the pins by which the two levers are articulated on the framework may be greater than the spacing between the pins for articulation on the griffe frame, in order to communicate to the latter a movement such that, in upper position, it is oriented obliquely with respect to its lower position.

BRIEF DESCRIPTION OF THE PREFERRED EMBODIMENT

The invention will be more readily understood on reading the following description with reference to the accompanying drawings, in which:

The single FIGURE illustrates in elevation a shed-forming device of a weaving loom, comprising a mechanism according to the invention for controlling the griffe frames.

DETAILED DESCRIPTION OF THE DRAWINGS

Referring now to the drawings, the single FIGURE illustrates a shed-forming device of a weaving loom in the form of a weave mechanism of the Jacquard type comprising a framework 1 inside which move two griffe frames 2 of which only one has been shown in order to simplify the drawing. Each of the griffe frames comprises a plurality of knives (not shown) adapted to cooperate with hooks associated with the heddles which control the different harness cords. Since such a shed-forming device is well known in the art, it is unnecessary to describe it in greater detail.

According to the invention, the control mechanism of each of the griffe frames is disposed on either side of the framework 1, with the result that each griffe frame is suspended with respect to its control mechanism. This arrangement is rendered possible by the fact that the width of the framework 1 is small in systems for making narrow fabrics on a weaving loom.

In all embodiments, the work 1 is traversed by a control shaft 3 rotating in synchronism with the control shaft of the loom. This shaft projects from each side of the framework and carries an eccentric 4. Each eccentric constitutes a crank pin about which is rotatably mounted the head of a connecting rod 5 of which the foot is articulated on a pivot pin 6 secured with the top of a lever 7 of generally triangular shape. On of the ends of the lever 7 is articulated with respect to the framework 1 about a pin 8, while its opposite end is articulated on the griffe frame 2 by a pin 9. The griffe frame 2 is further connected to the framework by a second lever 10 whose pivot pin 11 lies at a distance d below the pivot pin 9 of the lever 7 and which is different from the distance D separating pin 8 from pin 12 for articulation of lever 10 with respect to the framework 1. The assembly of the two levers 7 and 10 consequently constitutes an irregular deformable quadrilateral.

Upon rotation of shaft 3, the connecting rod 5 causes lever 7 to pivot about pin 8. Due to the presence of lever 10, the griffe frame 2 therefore moves so that, in upper position, illustrated in continuous lines, it is oriented obliquely with respect to its lower position shown in discontinuous lines.

The angular displacement a of lever 7, illustrated by dashed and dotted lines 13, 14, joining the centers of pins 8 and 9, causes oblique displacement of the griffe frame 2, with the result that the knives of this frame which are disposed along dashed and dotted line 15, lie in an oblique plane with respect to the plane in which they lie when the frame 2 is in its lower position. An oblique shed is thus obtained which is desired in order to facilitate passage of the picks.

It goes without saying that the eccentric 4 which controls the griffe frame 2 is offset by 180° with respect to the one which controls the second frame (not shown), so that these two members move alternately in opposite directions, in known manner.

It is observed that it may be provided to vary the distance d and D so as to change the obliqueness of the shed.

It must, moreover, be understood that the foregoing description has been given only by way of example and that it in no way limits the domain of the invention which would not be exceeded by replacing the details of execution described by any other equivalents.

What is claimed is:

1. In a weaving loom having a framework, a mechanism for controlling the reciprocating movement of two griffe frames of a shed-forming device, wherein the mechanism comprises, a first lever, a first pivot means for articulating one end of said first lever to the framework and a second pivot means for articulating the other end of said first lever to one of the griffe frames, a second lever, a third pivot means for articulating one end of said second lever to the framework and fourth pivot means for articulating the other end of said second lever to said one of the griffe frames, said first and second levers defining the first of two opposing sides of a shiftable quadrilateral, a portion of the framework between said first and third pivot means and a portion of said one of said griffe frames between said second and fourth pivot means defining a second of two opposing sides of said shiftable quadrilateral, and a control member connected to said first lever for reciprocally shifting said quadrilateral to thereby move said one of the griffe frames between first and second positions.

2. The weaving loom of claim 1 wherein the first and third pivot means are spaced at a first distance with respect to one another and said second and fourth pivot means are spaced at a second distance with respect to one another, said first and second distances being such as to cause said shiftable quadrilateral to move said one griffe frame obliquely from said first to said second position.

* * * * *

US005103873A

REEXAMINATION CERTIFICATE (2329th)

United States Patent [19]

Bassi

[11] B1 5,103,873

[45] Certificate Issued Jul. 5, 1994

[54] MECHANISM FOR CONTROLLING GRIFFE FRAME MOVEMENT

[75] Inventor: Dario Bassi, Chaponnay, France

[73] Assignee: Staubli-Verdol S.A., Chassieu, France

Reexamination Request:
No. 90/003,216, Oct. 8, 1993

Reexamination Certificate for:

| | |
|---|---|
| Patent No.: | **5,103,873** |
| Issued: | **Apr. 14, 1992** |
| Appl. No.: | **654,545** |
| Filed: | **Feb. 13, 1991** |

[30] Foreign Application Priority Data

Feb. 22, 1990 [FR] France ..... 90 02466

[51] Int. Cl.[5] ..... D03C 3/08; D03C 3/36

[52] U.S. Cl. ..... 139/59; 139/65

[58] Field of Search ..... 139/59, 65, 66; 74/25, 74/54

[56] References Cited

U.S. PATENT DOCUMENTS

| | | | |
|---|---|---|---|
| 3,096,792 | 7/1963 | Strach | 139/59 X |
| 3,480,044 | 11/1969 | Servillat | 139/59 |
| 4,022,251 | 5/1977 | Bucher | 139/59 |
| 4,936,352 | 6/1990 | Keim | 139/59 X |

FOREIGN PATENT DOCUMENTS

| | | |
|---|---|---|
| 899929 | 12/1953 | Fed. Rep. of Germany . |
| 433139 | 9/1967 | Switzerland . |

*Primary Examiner*—Andrew M. Falik
*Attorney, Agent, or Firm*—Dowell & Dowell

[57] ABSTRACT

A mechanism for controlling the movement of the griffe frames of shed-forming device in a weaving loom which includes a pair of levers which are pivotally mounted to the loom frame work and to one of the griffe frames in such a manner as to define a shiftable quadrilateral linkage which when reciprocated causes the griffe frame to move obliquely from a lower to a higher position to allow passage of the picks of the loom.

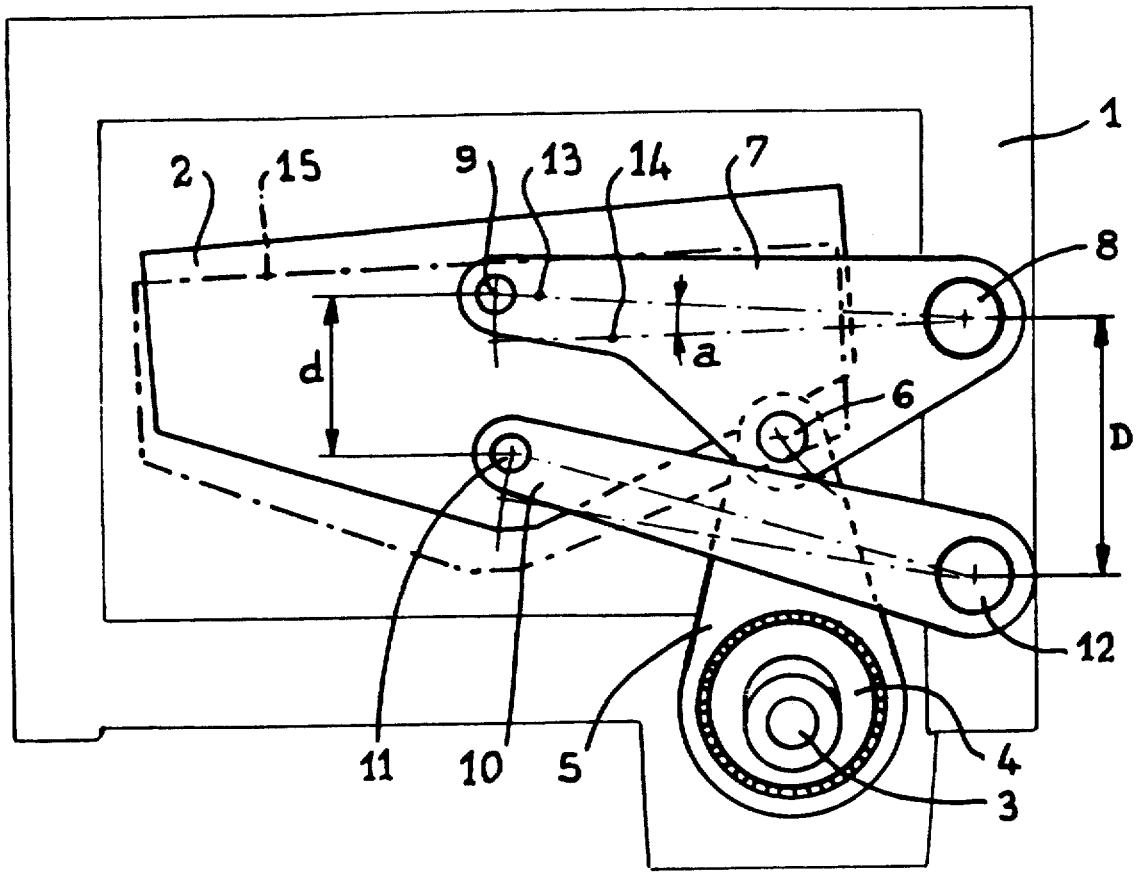

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 3–27:

In all embodiments, the work 1 is traversed by a control shaft 3 rotating in synchronism with the control shaft of the loom. This shaft projects from each side of the framework and carries an eccentric 4. Each eccentric constitutes a crank pin about which is rotatably mounted the head of a connecting rod 5 of which the foot is articulated on a pivot pin 6 secured with the top [of a] lever 7 [of] *which is* generally triangular in shape. [On] *One* of the ends of the lever 7 is articulated with respect to the framework 1 about a pin 8, while its opposite end is articulated on the griffe frame 2 by a pin 9. *As shown, the ends of the lever 7 are rigidly united to one another.* The griffe frame 2 is further connected to the framework by a second lever 10 whose pivot pin 11 lies at a distance d below the pivot pin 9 of the lever 7 and which is different from the distance D separating pin 8 from pin 12 for articulation of lever 10 with respect to the framework 1. *Also, as shown, the ends of the lever 10 are rigidly united to one another.* The assembly of the two levers 7 and 10 consequently constitutes an irregular deformable quadrilateral *having four (4) sides. As shown, the levers 7 and 10 define opposing jointless sides of the quadrilateral.*

Upon rotation of shaft 3, the connecting rod 5 *which is connected at pivot pin 6 in spaced relationship to the pivot pins 8 and 9 which connect the lever 7 to the framework and griffe frame, respectively,* causes lever 7 to pivot about pin 8. Due to the presence of lever 10, the griffe frame 2 therefore moves so that, in upper position, illustrated in continuous lines, it is oriented obliquely with respect to its lower position shown in discontinuous lines.

AS A RESULT OF REEXAMINATION, IT HAS BEEN DETERMINED THAT:

Claim 1 is determined to be patentable as amended.

Claim 2, dependent on an amended claim, is determined to be patentable.

New claims 3–6 and 7 are added and determined to be patentable.

1. In a weaving loom having a framework, a mechanism for controlling the reciprocating movement of two griffe frames of a shed-forming device, wherein the mechanism comprises, a first lever, a first pivot means for articulating one end of said first lever to the framework and a second pivot means for articulating the other end of said first lever to one of the griffe frames, a second lever, a third pivot means for articulating one end of said second lever to the framework and fourth pivot means for articulating the other end of said second lever to said one of the griffe frames, said first and second levers defining the first of two opposing *jointless* sides of a shiftable quadrilateral, a portion of the framework between said first and third pivot means and a portion of said one of said griffe frames between said second and fourth pivot means defining a second of two opposing sides of said shiftable quadrilateral, and a control member connected to said first lever for reciprocally shifting said quadrilateral to thereby move said one of the griffe frames between first and second positions.

*3. The weaving loom of claim 1 in which said control member is connected to said first lever in spaced relation from said first pivot means.*

*4. In a weaving loom having a framework, a mechanism for controlling the reciprocating movement of two griffe frames of a shed-forming device, wherein the mechanism comprises, a first lever, a first pivot means for articulating one end of said first lever to the framework and a second pivot means for articulating the other end of said first lever to one of the griffe frames, a second lever, a third pivot means for articulating one end of said second lever to the framework and fourth pivot means for articulating the other end of said second lever to said one of the griffe frames, said first and second levers defining the first of two opposing sides of a shiftable quadrilateral, a portion of the framework between said first and third pivot means and a portion of said one of said griffe frames between said second and fourth pivot means defining a second of two opposing sides of said shiftable quadrilateral, and a control member connected to said first lever in spaced relationship from said first pivot means for reciprocally shifting said quadrilateral to thereby move said one of the griffe frames between first and second positions.*

*5. The weaving loom of claim 4 wherein the first and third pivot means are spaced at a first distance with respect to one another and said second and fourth pivot means are spaced at a second distance with respect to one another, said first and second distances being such as to cause said shiftable quadrilateral to move said one griffe frame obliquely from said first to said second position.*

*6. In a weaving loom having a framework, a mechanism for controlling the reciprocating movement of two griffe frames of a shed-forming device, wherein the mechanism comprises, a first lever, a first pivot means for articulating one end of said first lever to the framework and a second pivot means for articulating the other end of said first lever to one of the griffe frames, a second lever, a third pivot means for articulating one end of said second lever to the framework and fourth pivot means for articulating the other end of said second lever to said one of the griffe frames, said ends of said first lever being rigidly united to one another and said ends of said second lever being rigidly united to one another, said first and second levers defining the first of two opposing sides of a shiftable quadrilateral, a portion of the framework between said first and third pivot means and a portion of said one of said griffe frames between said second and fourth pivot means defining a second of two opposing sides of said shiftable quadrilateral, and a control member connected to said first lever for reciprocally shifting said quadrilateral to thereby move said one of the griffe frames between first and second positions.*

*7. The weaving loom of claim 6 wherein the first and third pivot means are spaced at a first distance with respect to one another and said second and fourth pivot means are spaced at a second distance with respect to one another, and said first and second distances being such as to cause said shiftable quadrilateral to move said one griffe frame obliquely from said first to said second position.*

* * * * *

US005103873B1

REEXAMINATION CERTIFICATE (2730th)

United States Patent [19]

Bassi

[11] B2 5,103,873

[45] Certificate Issued Nov. 14, 1995

[54] MECHANISM FOR CONTROLLING GRIFFE FRAME MOVEMENT

[75] Inventor: Dario Bassi, Chaponnay, France

[73] Assignee: Staubli-Verdol S.A., Chassieu, France

Reexamination Request:
No. 90/003,744, Mar. 3, 1995

Reexamination Certificate for:

| | |
|---|---|
| Patent No.: | **5,103,873** |
| Issued: | **Apr. 14, 1992** |
| Appl. No.: | **654,545** |
| Filed: | **Feb. 13, 1991** |
| | **Reexamination Certificate B0 5,103,873 issued Jul. 5, 1994** |

[51] Int. Cl.[6] ..... D03C 3/08; D03C 3/36

[52] U.S. Cl. ..... 139/59; 139/65; 139/68

[58] Field of Search ..... 139/59, 65, 66, 139/68, 74; 74/25, 54

[56] References Cited

U.S. PATENT DOCUMENTS

| | | |
|---|---|---|
| 2,751,938 | 6/1953 | Staubli et al. . |
| 3,096,792 | 7/1963 | Strach . |
| 3,480,044 | 11/1969 | Servillat . |
| 4,022,251 | 5/1977 | Bucher . |
| 4,936,352 | 6/1990 | Keim . |

FOREIGN PATENT DOCUMENTS

| | | |
|---|---|---|
| 433139 | 9/1967 | Switzerland . |
| 986770 | 3/1965 | United Kingdom . |
| 1032014 | 6/1966 | United Kingdom . |
| 2047755 | 3/1980 | United Kingdom . |

OTHER PUBLICATIONS

Konstruieren und Rechnen, Haeder 1954, p. 81, FIGS. 1 & 4 partial translation.

*Primary Examiner*—Andy Falik

[57] ABSTRACT

A mechanism for controlling the movement of the griffe frames of shed-forming device in a weaving loom which includes a pair of levers which are pivotally mounted to the loom frame work and to one of the griffe frames in such a manner as to define a shiftable quadrilateral linkage which when reciprocated causes the griffe frame to move obliquely from a lower to a higher position to allow passage of the picks of the loom.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 5 and 7 are cancelled.

Claims 1, 4 and 6 are determined to be patentable as amended.

Claim 3, dependent on an amended claim, is determined to be patentable.

1. In a weaving loom having a framework, a mechanism for controlling the reciprocating movement of two griffe frames of a shed-forming device, wherein the mechanism comprises, a first lever, a first pivot means for articulating one end of said first lever to the framework, and a second pivot means for articulating the other end of said first lever to one of the griffe frames, a second lever, a third pivot means for articulating one end of said second lever to the framework, and fourth pivot means for articulating the other end of said second lever to said one of the griffe frames, said first and second levers defining the first of two opposing jointless sides of a shiftable quadrilateral, a portion of the framework between said first and third pivot means and a portion of said one of [said] *the* griffe frames between said second and fourth pivot means defining a second of two opposing sides of said shiftable quadrilateral, *said first and third pivot means being spaced at a first distance with respect to one another and said second and fourth pivot means being spaced at a second distance with respect to one another, said first and second distances being such as to cause said shiftable quadrilateral to move said one of the griffe frames obliquely from said first to said second position,* and a control member connected to said first lever for reciprocally shifting said quadrilateral to thereby move said one of the griffe frames between *said* first and second positions.

4. In a weaving loom having a framework, a mechanism for controlling the reciprocating movement of two griffe frames of a shed-forming device, wherein the mechanism comprises, a first lever, a first pivot means for articulating one end of said first lever to the framework, and a second pivot means for articulating the other end of said first lever to one of the griffe frames, a second lever, a third pivot means for articulating one end of said second lever to the framework, and fourth pivot means for articulating the other end of said second lever to said one of the griffe frames, said first and second levers defining the first of two opposing sides of a shiftable quadrilateral, a portion of the framework between said first and third pivot means and a portion of said one of [said] *the* griffe frames between said second and fourth pivot means defining a second of two opposing sides of said shiftable quadrilateral, *said first and third pivot means being spaced at a first distance with respect to one another and said second and fourth pivot means being spaced at a second distance with respect to one another, said first and second distances being such as to cause said shiftable quadrilateral to move said one of the griffe frames obliquely from said first to said second position,* and a control member connected to said first lever in spaced relationship from said first pivot means for reciprocally shifting said quadrilateral to thereby move said one of the griffe frames between *said* first and second positions.

6. In a weaving loom having a framework, a mechanism for controlling the reciprocating movement of two griffe frames of a shed-forming device, wherein the mechanism comprises, a first lever, a first pivot means for articulating one end of said first lever to the framework, and a second pivot means for articulating the other end of said first lever to one of the griffe frames, a second lever, a third pivot means for articulating one end of said second lever to the framework, and fourth pivot means for articulating the other end of said second lever to said one of the griffe frames, said ends of said first lever being rigidly united to one another and said ends of said second lever being rigidly united to one another, said first and second levers defining the first of two opposing sides of a shiftable quadrilateral, a portion of the framework between said first and third pivot means and a portion of said one of [said] *the* griffe frames between said second and fourth pivot means defining a second of two opposing sides of said shiftable quadrilateral, *said first and third pivot means being spaced at a first distance with respect to one another and said second and fourth pivot means being spaced at a second distance with respect to one another, said first and second distances being such as to cause said shiftable quadrilateral to move said one of the griffe frames obliquely from said first to said second position,* and a control member connected to said first lever for reciprocally shifting said quadrilateral to thereby move said one of the griffe frames between *said* first and second positions.

* * * * *